US007178475B2

(12) United States Patent
Hall, Jr. et al.

(10) Patent No.: US 7,178,475 B2
(45) Date of Patent: Feb. 20, 2007

(54) HIGH MANEUVERABILITY TOWCRAFT

(76) Inventors: Herbert La Verne Hall, Jr., 1371 Pleasant Valley Rd., Newark, OH (US) 43055; J. Douglas Hamilton, 1551 Independence Dr., Newark, OH (US) 43055

( * ) Notice: Subject to any disclaimer, the term of this patent is extended or adjusted under 35 U.S.C. 154(b) by 0 days.

(21) Appl. No.: 11/014,670

(22) Filed: Dec. 15, 2004

(65) Prior Publication Data

US 2005/0166820 A1 Aug. 4, 2005

Related U.S. Application Data

(60) Provisional application No. 60/544,432, filed on Feb. 16, 2004, provisional application No. 60/529,813, filed on Dec. 16, 2003.

(51) Int. Cl.
*B63B 21/56* (2006.01)
*B63B 35/00* (2006.01)

(52) U.S. Cl. ..... 114/242; 441/65

(58) Field of Classification Search ..... 114/242, 114/246; 441/65, 66, 79
See application file for complete search history.

(56) References Cited

U.S. PATENT DOCUMENTS

| | | | | |
|---|---|---|---|---|
| 2,815,518 | A | 12/1957 | Kuehn | |
| 2,865,032 | A | 12/1958 | Moody, Jr. | |
| 2,910,708 | A | 11/1959 | Albright | |
| 3,027,574 | A * | 4/1962 | Meehan | 441/69 |
| 3,092,857 | A | 6/1963 | Churchman | |
| 3,581,328 | A | 6/1971 | Smith | |
| 4,213,413 | A | 7/1980 | Courtney | |
| 4,302,858 | A | 12/1981 | Casiano | |
| 4,331,340 | A * | 5/1982 | Bolen | 280/845 |
| 4,361,103 | A | 11/1982 | Willat | |
| 4,708,675 | A | 11/1987 | Shoeffler et al. | |
| 5,076,189 | A | 12/1991 | Jones | |
| 5,247,898 | A * | 9/1993 | Thornlimb | 114/246 |
| 5,462,001 | A * | 10/1995 | Lemelson | 114/253 |
| 5,472,362 | A * | 12/1995 | Dandurand | 441/65 |
| 5,702,278 | A | 12/1997 | Boucher | |
| 5,819,680 | A * | 10/1998 | Haller et al. | 114/253 |
| 5,881,665 | A | 3/1999 | Ratcliff | |
| 5,888,110 | A | 3/1999 | Haller et al. | |
| 5,899,782 | A | 5/1999 | Martin | |
| 5,906,526 | A | 5/1999 | Freeman | |
| 5,951,347 | A * | 9/1999 | Hudson et al. | 441/79 |
| 6,006,690 | A | 12/1999 | Roy | |
| 6,149,479 | A | 11/2000 | Redmon et al. | |
| 6,182,594 | B1 | 2/2001 | Wilson | |
| 6,247,984 | B1 * | 6/2001 | Hatcher | 441/66 |

(Continued)

*Primary Examiner*—Jesús D. Sotelo
(74) *Attorney, Agent, or Firm*—MacMillan, Sobanski & Todd, LLC

(57) ABSTRACT

A maneuverable towcraft consisting of a partial hull structure to which is removably attached at least three downward-projecting fins. A first ventral fin of sufficient size and draft is located along the craft's centerline, toward the front of the craft. A second and third fin, smaller in size and draft relative to the ventral fin, are laterally spaced-apart at a station aft of the ventral fin. The towline attachment to the towcraft is at a point above the craft's operative waterline and situated such that the towline line-of-force intersects, or very nearly intersects, the ventral fin's effective vertical zero-moment line for normal towline attitudes. Maneuvering of the towcraft by its one or more riders is accomplished by differential drag means.

18 Claims, 4 Drawing Sheets

U.S. PATENT DOCUMENTS 6,428,376 B1 * 8/2002 Reeder ..... 441/65
6,477,976 B2 11/2002 Van Gelder
6,638,125 B1 10/2003 Mossel
6,655,701 B2 12/2003 Oberpriller
6,869,323 B2 * 3/2005 Norman ..... 440/28
D505,987 S * 6/2005 Peterson ..... D21/770

* cited by examiner

HIGH MANEUVERABILITY TOWCRAFT

RELATED APPLICATIONS

This invention claims priority by way of reference to Provisional Application Ser. No. 60/529,813 filed Dec. 16, 2003, and Provisional Application Patent Ser. No. 60/544,432 filed Feb. 16, 2004.

BACKGROUND OF THE INVENTION

The present invention relates to recreational watercraft of the type which is directly pulled or towed behind power boats, personal watercraft (PWC), and the like. A primary object of the present invention is to devise the most basic highly maneuverable towcraft that one rider, or multiple riders can operate, not only from the standpoint of construction and cost, but also in its operation.

According to this invention there is provided a high maneuverability towcraft that includes a means for ensuring that during normal on-the-water operations the towline line-of-force intersects, or nearly intersects, a vertical line extending through the areal moment center of the primary water-engaging fin. The towcraft includes an above-the-waterline towline attachment means, and optionally a means whereby more than one rider may cooperatively participate in maneuvering the towcraft. In one embodiment there is provided a means for easy ingress onto the towcraft from the rear of the towcraft. In another embodiment there is provided a means whereby the rider may secure a sure grip on the towcraft while at the same time allow for aggressive weight-shifting.

SUMMARY OF THE INVENTION

According to this invention there is provided a high maneuverability towcraft that includes a means for ensuring that during normal on-the-water operations the towline line-of-force intersects, or nearly intersects, a vertical line extending through the areal moment center, hereinafter called zero moment line, of the primary water-engaging ventral fin; and, the provision of two spaced-apart fins aft of the ventral fin. The towcraft includes an above-the-waterline towline attachment means, and optionally a means whereby more than one rider may cooperatively participate in maneuvering the towcraft. In one embodiment there is provided a means for easy ingress onto the towcraft from the rear of the towcraft. In another embodiment there is provided a means whereby the rider may secure a sure grip on the towcraft while at the same time allow for aggressive weight-shifting.

In another embodiment, the towline of the towcraft is simply attached to a point directly above the forward-mounted ventral fin, at a vertical line passing through the zero moment line of the ventral fin. Two slightly toed-out, or, optionally, parallel-aligned spaced-apart trailing fins are provided such that hull rotation is induced upon a rider's leaning or weight-shifting action. In one embodiment, the floor of the towcraft is cushioned by an elastomeric covering means which extends to the stern end of the towcraft whereby collected water is automatically drained away. Further, an optional centered, longitudinal, inflated half-tube extends along the floor whereby a kneeling rider is further supported both laterally and vertically.

DETAILED DESCRIPTION OF THE INVENTION

Figure 1:
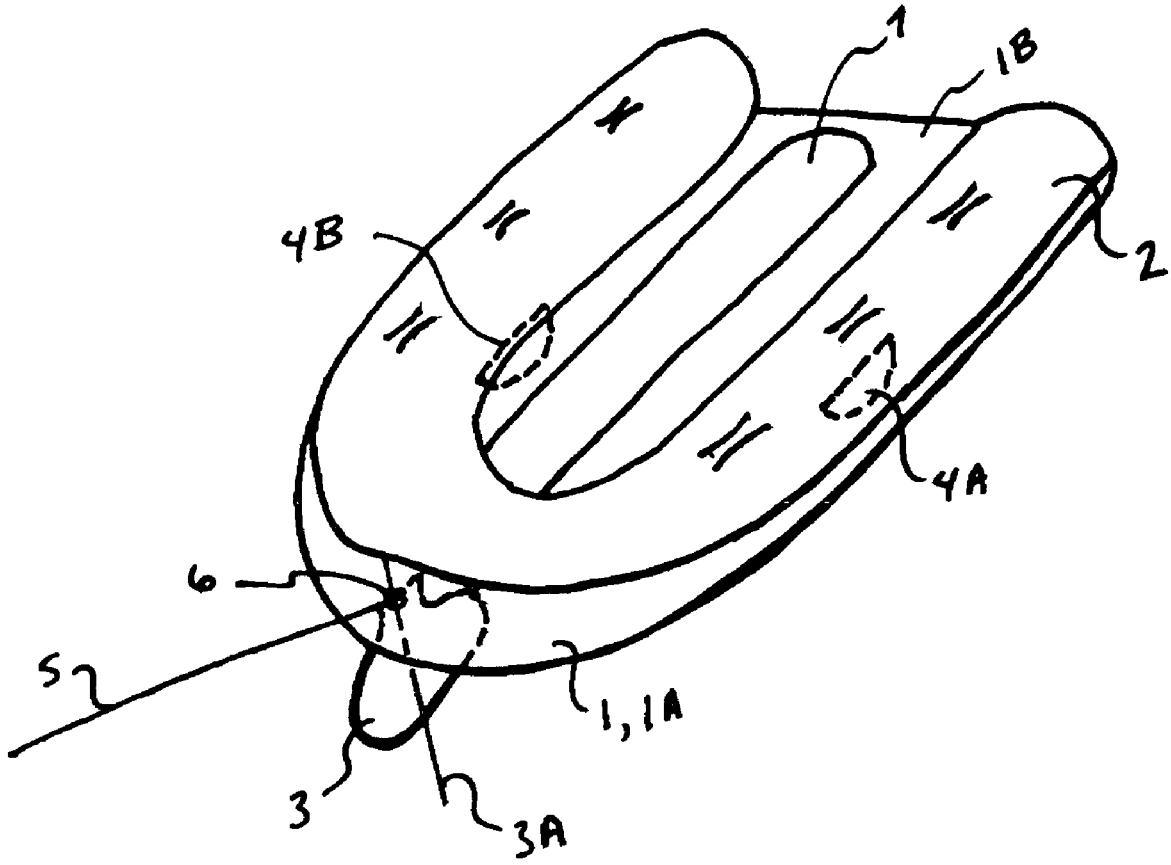
FIG. 1 illustrates the towcraft of the invention.

This invention consists of a thin, lightweight, structural, lower partial hull which reinforces or stiffens the towcraft and serves as a mounting location for the fins; and, an upper part that is preferably cushioned. The cushioned upper, consisting of either foam, or one or more inflation chambers, or a combination of both, presents a resilient surface to the rider and also functions as a flotation means.

The general shape of the towcraft resembles that of an elongated horseshoe or a toroidal shaped tube. In one embodiment, the side and front portion above the hull consists of one or more fabric-covered inflation chambers, while the upper surface of the flat floor is foam covered, or, more preferably, includes the addition of an inflated half-tube on which a kneeling person may straddle. Handles are provided in the cover as a simple means whereby one rider, or multiple riders, may shift their weight from side-to-side without changing their grip. The stern end of the towcraft is left open, thereby making it easy for riders to climb aboard. Also, the flat exposed floor at the stern end allows any collected water to drain when the towcraft is underway. Further, the flat termination of the floor at the stern end counters any Coanda Effect.

The bow end of the hull is optionally made to sweep upwards and back a short distance above the craft's waterline. Lying along the centerline of the towcraft, a D-ring, strap, or other robust towline attachment means is provided. Immediately below the towline attachment point is the areal moment center of a fixed primary water-engaging device consisting of a ventral fin. The areal moment center or the effective zero-moment line of the ventral fin is the line on the ventral fin at which the effective moment of the ventral fin area forward of the line substantially equals the effective moment of the ventral fin area rearward of the line.

The ventral fin is optionally removably attached to the bow-end of the hull by its neck portion. As a result of the ventral fin's forward mounting, and its characteristic balanced, or nearly balanced (front/rear area) design, the forward-most end of the ventral fin can extend beyond the front of the towcraft's hull. Therefore, it is preferable that the leading edge of the ventral fin is itself cushioned with a layer of rubber or other elastomeric material.

A short distance astern of the ventral fin, two spaced-apart, trailing or rear fins are provided. Preferably, the trailing fins are slightly toed-out (spaced further apart at the forward end). When a leaning action by the one or more riders ensues, the drag differential between its left and right side causes the towcraft to rotate in the direction of the lean, thereby causing the towcraft to proceed in that direction.

It should be noted that the substitution or addition of flexible trailing fins, or pivotable trailing fins, or curved trailing fins, an extra set of spaced-apart trailing fins positioned aft of the first set, an operable pivoting handlebar, or a stationary one with twist grips which manipulate alternate pivoting fins sequentially, or ventral fin-mounted inclined planes, or other contemplated embodiments do not depart from the scope of the invention.

With reference to FIG. 1, the present invention consists of a hull 1, a bow-end 1A, a stern-end 1B, inflated upper 2 (shown covered), ventral fin 3, ventral fin zero moment line 3A, spaced-apart trailing fins 4A and 4B, towline 5, towline attachment point 6, and inflated half-tube 7.

Figure 2:
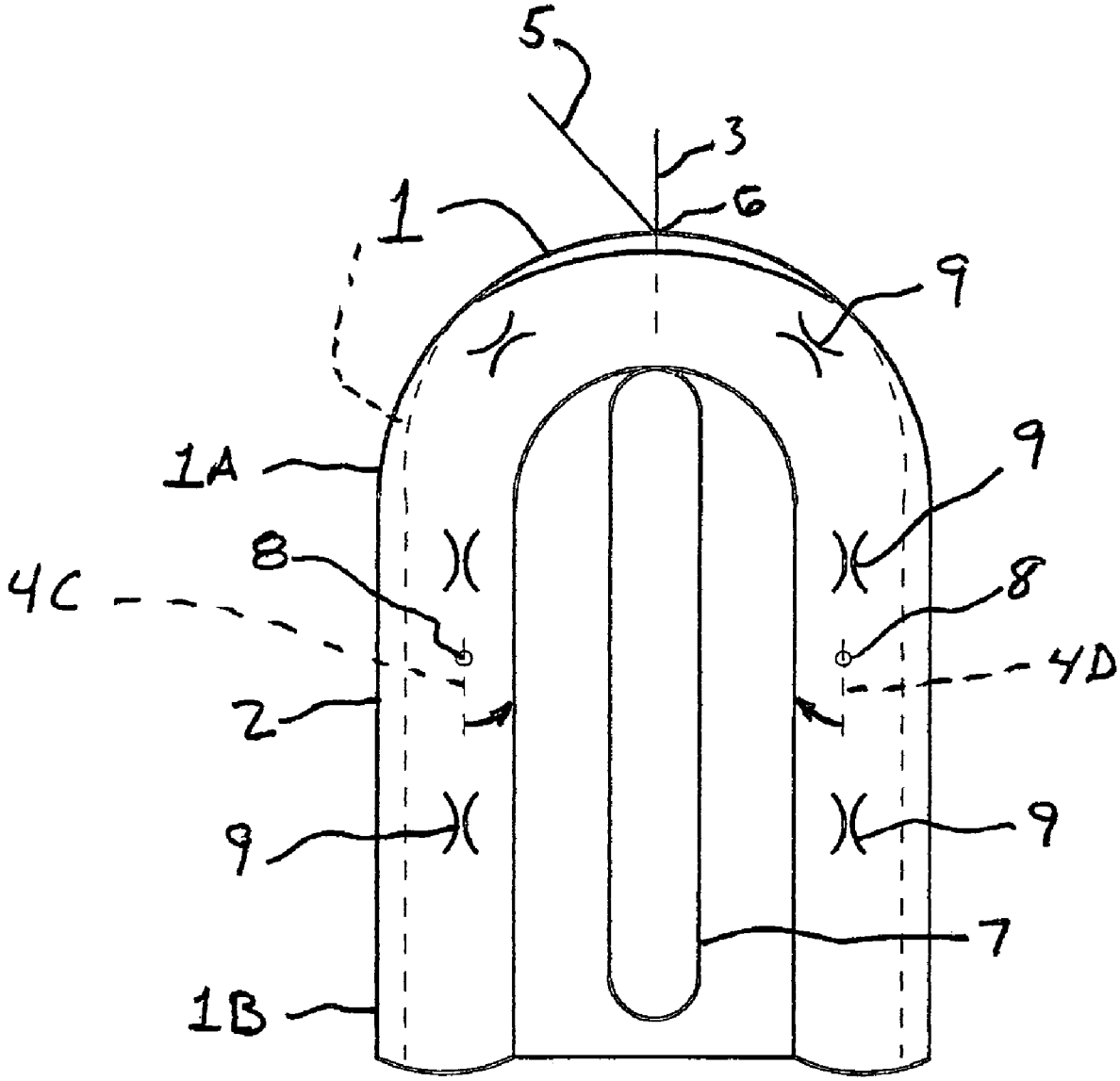
FIG. 2 illustrates an embodiment of the towcraft, showing pivotable rear fins.

As shown in FIG. 2, the towcraft includes a hull 1 including a bow end 1A, a stern end 1B, and an inflated upper body 2. The water-engaging ventral fin 3 is mounted near the bow end 1A of the towcraft, and the ventral fin 3 extends below the waterline. The towline 5 is attached at attachment point 6, which is substantially on a vertical line extending through the ventral fin zero moment line of the fin. Inflated half-tube 7 extends along the interior of the towcraft. Rear fins 4C and 4D are mounted for pivoting about pivot points 8, in the direction of the arrows. The towcraft includes handles 9 for grasping by a rider of the towcraft.

Figure 3:
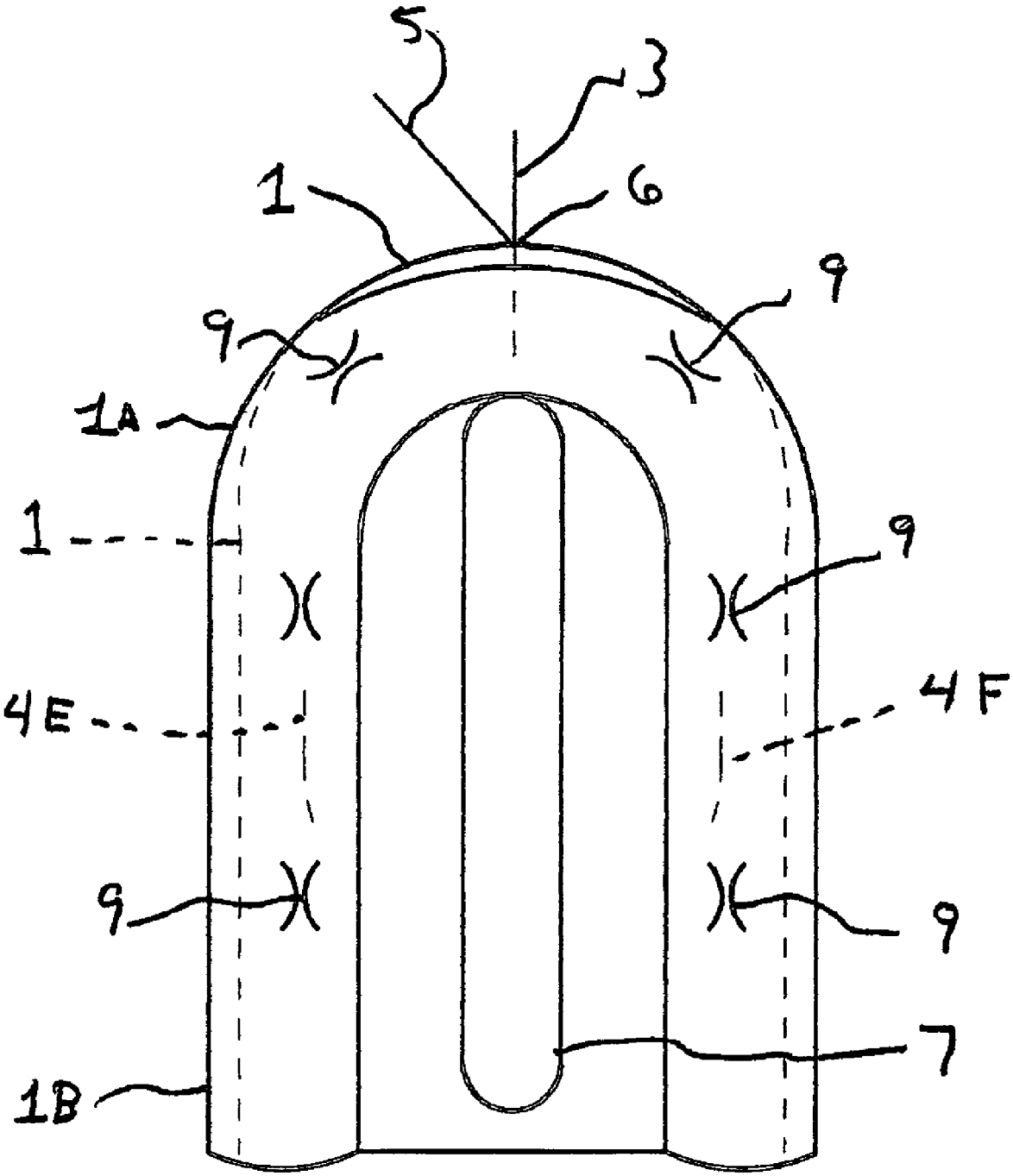
FIG. 3 illustrates another embodiment of the towcraft, showing curved rear fins.

As shown in FIG. 3, the towcraft includes curved rear fins 4E and 4F.

Figure 4:
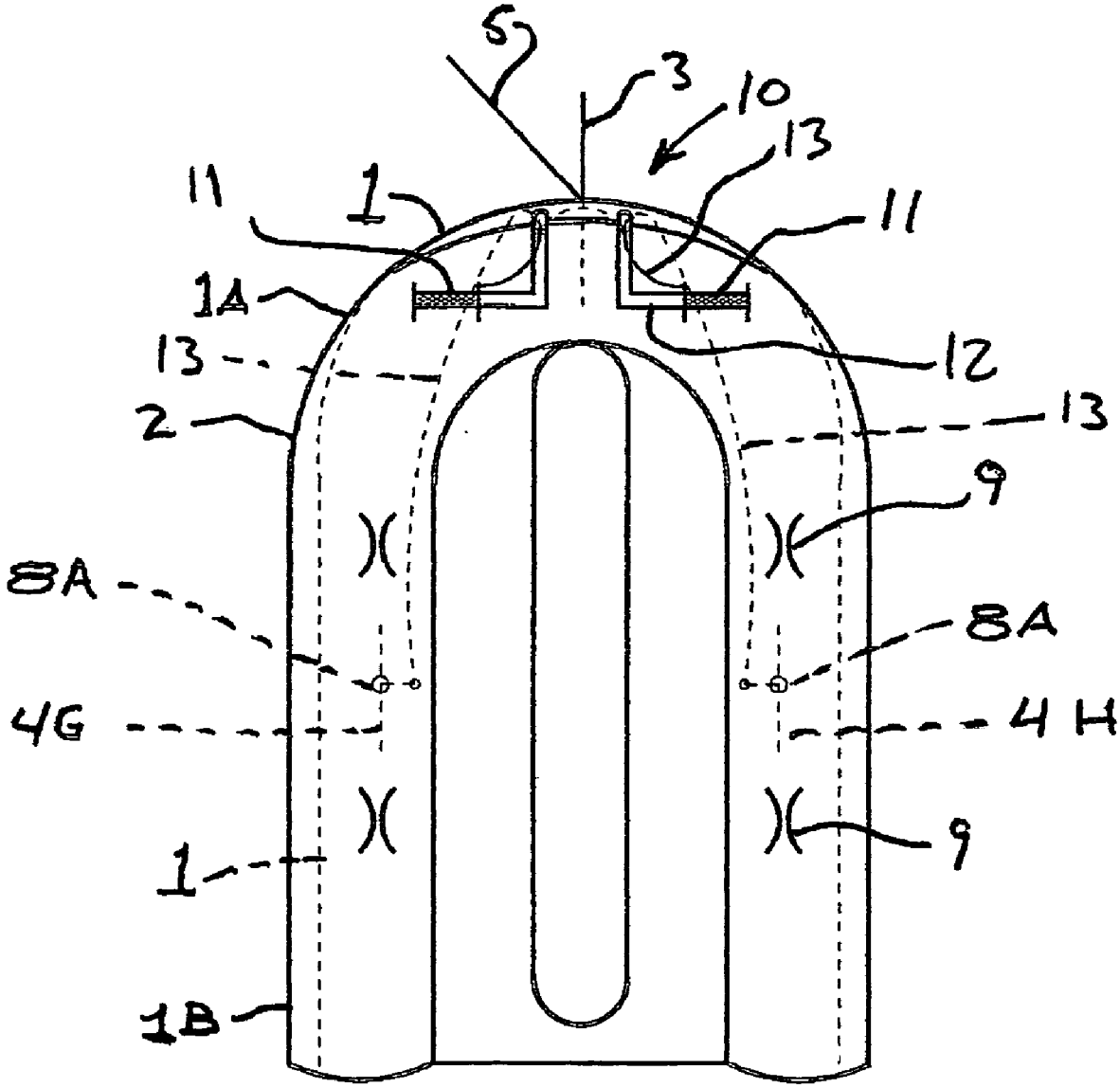
FIG. 4 illustrates yet another embodiment of the towcraft, showing a handlebar configured to orient the rear fins.

As shown in FIG. 4, the towcraft includes rear fins 4G and 4H that are pivotally mounted about pivot points 8A. The towcraft has a handlebar 10 that includes twist grips 11 mounted on a mounting brackets 12. The twist grips 11 are connected to cables 13 that extend all the way back to the rear fins 4G and 4H. Rotation of the twist grips 11 of the handlebar 10 pulls the cables 13 to turn the rear fins 4G and 4H, and thereby steer the towcraft.

The towcraft is maneuverable from side-to-side by the intuitive leaning action of one or more riders thereon. The towcraft consists of a partial hull structure, upwardly curved at the bow end. Optionally, the towcraft has a predominantly flat bottom and stern, and an inflated, or otherwise cushioned, upper portion which is fitted with handles for the riders to securely grasp. At least three downward-projecting fins are removably attached to the partial hull structure. The first fin 3 is of sufficient or suitable size and draft, and is ventrally located along the craft's centerline, toward the front of the towcraft. The second and third fins, 4A and 4B, are smaller in size and draft relative to the ventral fin 3, and are laterally spaced-apart, preferably, at a station at or aft of the towcraft's center of gravity. The towline attachment 6 to the front of the towcraft is at a point above the towcraft's operative waterline and situated such that the towline line-of-force substantially intersects, or very nearly intersects, the ventral fin's zero-moment line 3A for normal towline attitudes.

We claim:

1. A towcraft configured to be towed in water by a towline, the towcraft including a bow end, a stern end and a waterline, the towcraft comprising:

a water-engaging ventral fin mounted at the bow end of the towcraft and extending below the waterline, the ventral fin having a ventral fin zero moment line; and a towline attachment to the bow end of the towcraft, the towline attachment being positioned above the waterline, and the towline being attached to the towcraft in a manner such that the towline line-of-force always substantially intersects a vertical line extending through the ventral fin zero moment line.

2. The towcraft of claim 1 in which the ventral fin extends forward of the bow of the towcraft.

3. The towcraft of claim 1 in which the front of ventral fin is cushioned with an elastic material.

4. The towcraft of claim 1 in which the ventral fin is removably attached to the bow end of the towcraft.

5. The towcraft of claim 1 including a pair of rear fins positioned rearward of the ventral fin.

6. The towcraft of claim 5 in which the rear fins are smaller in size and draft than the ventral fin.

7. The towcraft of claim 5 in which the rear fins are parallel to each other.

8. The towcraft of claim 5 in which the rear fins are toed out.

9. The towcraft of claim 5 in which the rear fins are flexible.

10. The towcraft of claim 5 in which the rear fins are pivotable.

11. The towcraft of claim 5 in which the rear fins are curved.

12. The towcraft of claim 1 including a handlebar configured to orient the rear fins.

13. The towcraft of claim 1 in which the towcraft has a flat exposed floor at the stern end, and the floor is configured to allow collected water to drain away, and to allow easy ingress to the towcraft at the stern end.

14. The towcraft of claim 1 in which the towcraft has a floor with a centered, longitudinal, inflated half-tube.

15. The towcraft of claim 1 including handles for grasping by a rider.

16. A towcraft configured to be towed in water by a towline, the towcraft including a hull having a bow end, a stern end, and a waterline, the towcraft comprising:

a water-engaging ventral fin mounted at the bow end of the towcraft and extending below the waterline, the ventral fin having a ventral fin zero moment line;

a towline attachment to the bow end of the towcraft, the towline attachment being positioned above the waterline, and the towline being attached to the towcraft in a manner such that the towline line-of-force always substantially intersects a vertical line extending through the ventral fin zero moment line;

a pair of rear fins positioned rearward of the ventral fin; and a flat exposed floor at the stern end, the floor being configured to allow collected water to drain away, and to allow easy ingress at the stern end.

17. The towcraft of claim 16 in which the rear fins are smaller in size and draft than the ventral fin.

18. A towcraft configured to be towed in water by a towline, the towcraft including a hull having a bow end, a stern end, and a waterline, the towcraft comprising:

a water-engaging ventral fin mounted at the bow end of the towcraft and extending below the waterline, the ventral fin having a ventral fin zero moment line;

a towline attachment to the bow end of the towcraft, the towline attachment being positioned above the waterline, and the towline being attached to the towcraft in a manner such that the towline line-of-force always substantially intersects a vertical line extending through the ventral fin zero moment line;

a pair of rear fins positioned rearward of the ventral fin, the rear fins being smaller in size and draft than the ventral fin; and a flat exposed floor at the stern end, the floor configured to allow collected water to drain away, and to allow easy ingress at the stern end, the floor having a centered, longitudinal, inflated half-tube.

* * * * *